US005806638A

United States Patent [19]

Mao

[11] Patent Number: 5,806,638

[45] Date of Patent: Sep. 15, 1998

[54] PULL ROD BASE OF LUGGAGE

[76] Inventor: Chen Show Mao, P.O. Box 453, Taichung, Taiwan

[21] Appl. No.: 818,943

[22] Filed: Mar. 17, 1997

[51] Int. Cl.[6] ..... A45C 5/14

[52] U.S. Cl. ..... 190/115; 190/18 A; 190/127; 16/115

[58] Field of Search ..... 190/18 A, 102, 190/115, 117, 39, 127; 16/115

[56] References Cited

U.S. PATENT DOCUMENTS 5,524,737 6/1996 Wang ..... 190/18 A
5,575,362 11/1996 Franklin et al. ..... 190/115
5,588,513 12/1996 Lin ..... 190/115
5,590,748 1/1997 Chang ..... 190/18 A

*Primary Examiner*—Stephen Cronin

[57] ABSTRACT

A base for mounting a luggage pull rod is composed of at least one guide hole for holding the luggage pull rod, a mounting hole for fastening the base with the luggage shell, and a fastening member for fastening the base with the luggage shell in conjunction with the mounting hole. The fastening member comprises a head and two parallel arms extending in the same direction from the head such that free ends of the two arms form together a hooked portion engageable with the retaining slot of the mounting hole.

3 Claims, 6 Drawing Sheets

PULL ROD BASE OF LUGGAGE

FIELD OF THE INVENTION

The present invention relates generally to a luggage accessory, and more particularly to a base of a pull rod of the luggage.

BACKGROUND OF THE INVENTION

The conventional luggages are generally provided with one or more pull rods 11, as shown in FIGS. 1 and 2. The pull rod 11 is fastened with a base 13, which is provided with a fastening hole 14 and is mounted on a luggage shell 10 by a rivet 15 or nail 16 engaging the fastening hole 14.

Such a prior art base 13 as described above is defective in design in that the luggage shell 10 is suscepticle to damage by the rivet 15 or nail 16, and that the esthetic effect of the luggage is undermined by the presence of the rivet 15 or nail 16, and further that the work of fastening the base 13 with the luggage shell 10 is time-consuming.

SUMMARY OF THE INVENTION

The primary objective of the present invention is to provide a luggage with an improved pull rod base which is free from the shortcomings of the prior art base of the luggage pull rod.

In keeping with the principle of the present invention, the foregoing objective of the present invention is attained by a base for mounting a luggage pull rod. The base comprises one guide hole and a mounting hole for fastening the base with a luggage shell in conjunction with a fastening member. The fastening member is engaged with a fastening hole of the luggage shell and is composed of a head and two parallel arms extending from the head such that the free ends of the two parallel arms form together a hooked portion which is engaged with a retaining slot of the mounting hole of the base.

The foregoing objective, features and functions of the present invention will be more readily understood upon a thoughtful deliberation of the following detailed description of the embodiment of the present invention in conjunction with the accompanying drawings.

DETAILED DESCRIPTION OF THE EMBODIMENT

Figure 1:
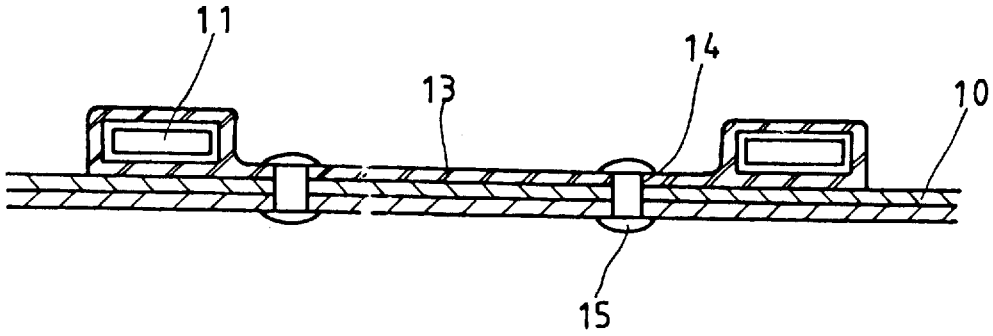
FIG.1 PRIOR ART
FIG. 1 shows a persepctive view of a prior art base of the luggage pull rod.
Figure 2:
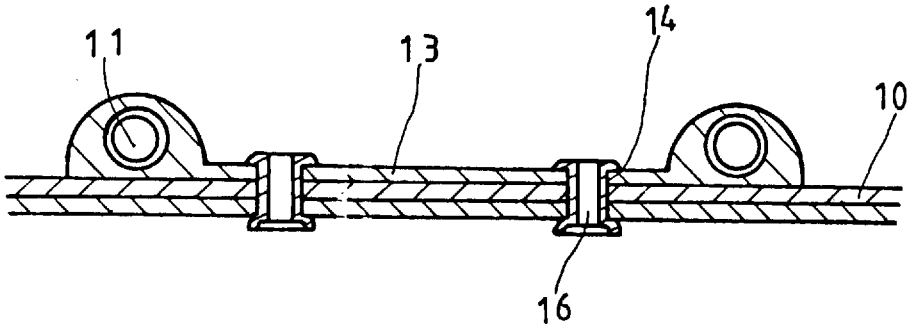
FIG.2 PRIOR ART
FIG. 2 shows a partial sectional view of the prior art base as shown in FIG. 1.
Figure 3:
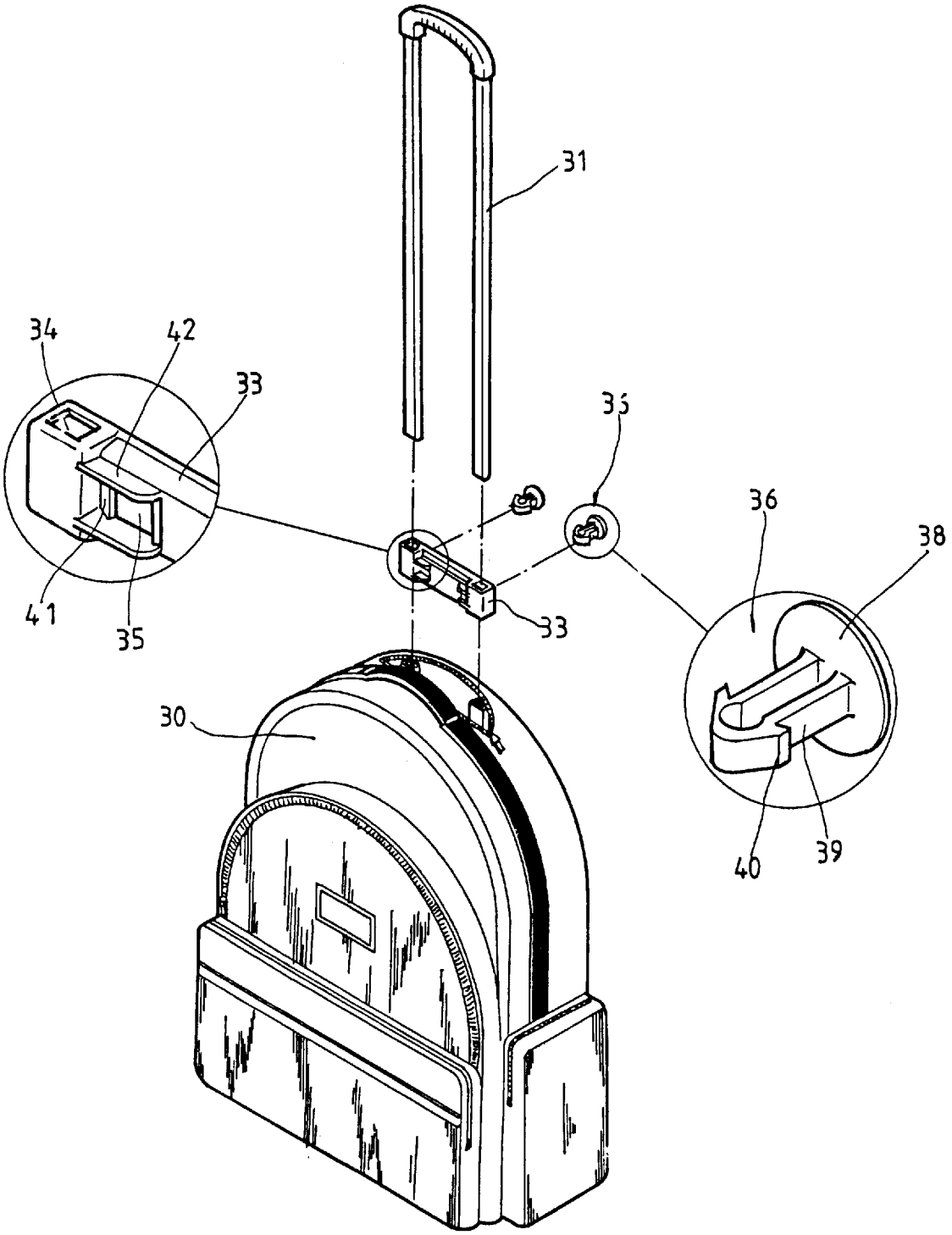
FIG. 3 shows an exploded view of a base of the present invention for mounting the luggage pull rod.
Figure 4:
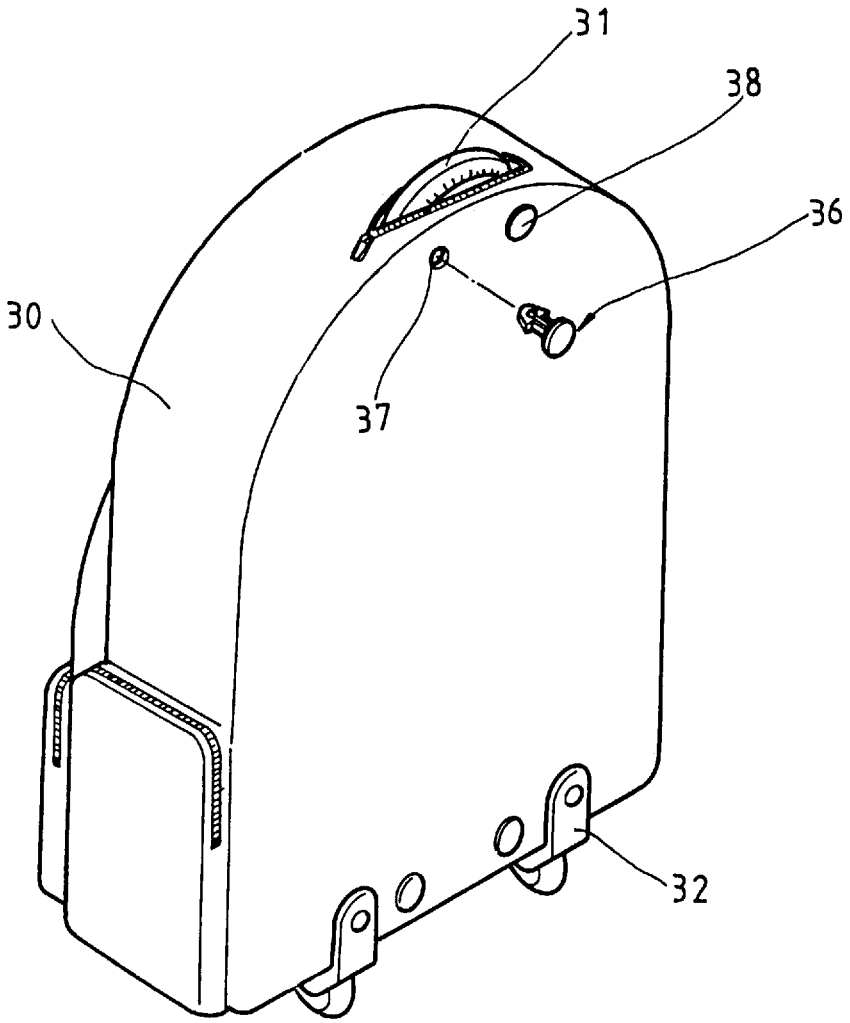
FIG. 4 is a schematic view illustrating the structural relationship between the fastening member of the present invention and a luggage shell.
Figure 5:
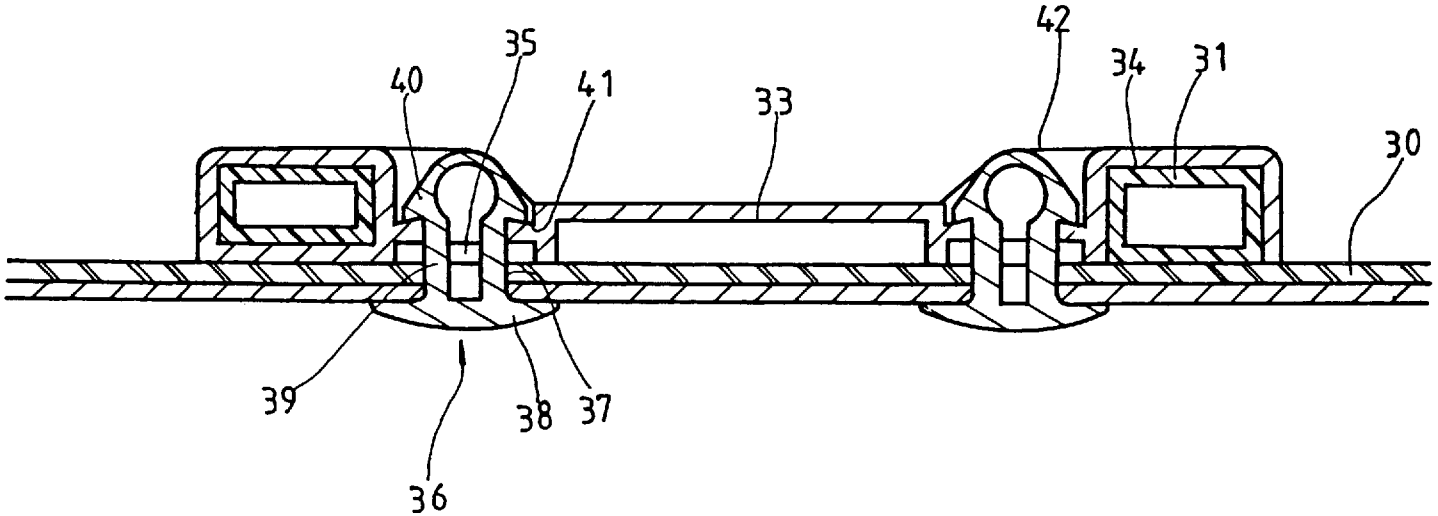
FIG. 5 shows a sectional view of the present invention in combination.
Figure 6:
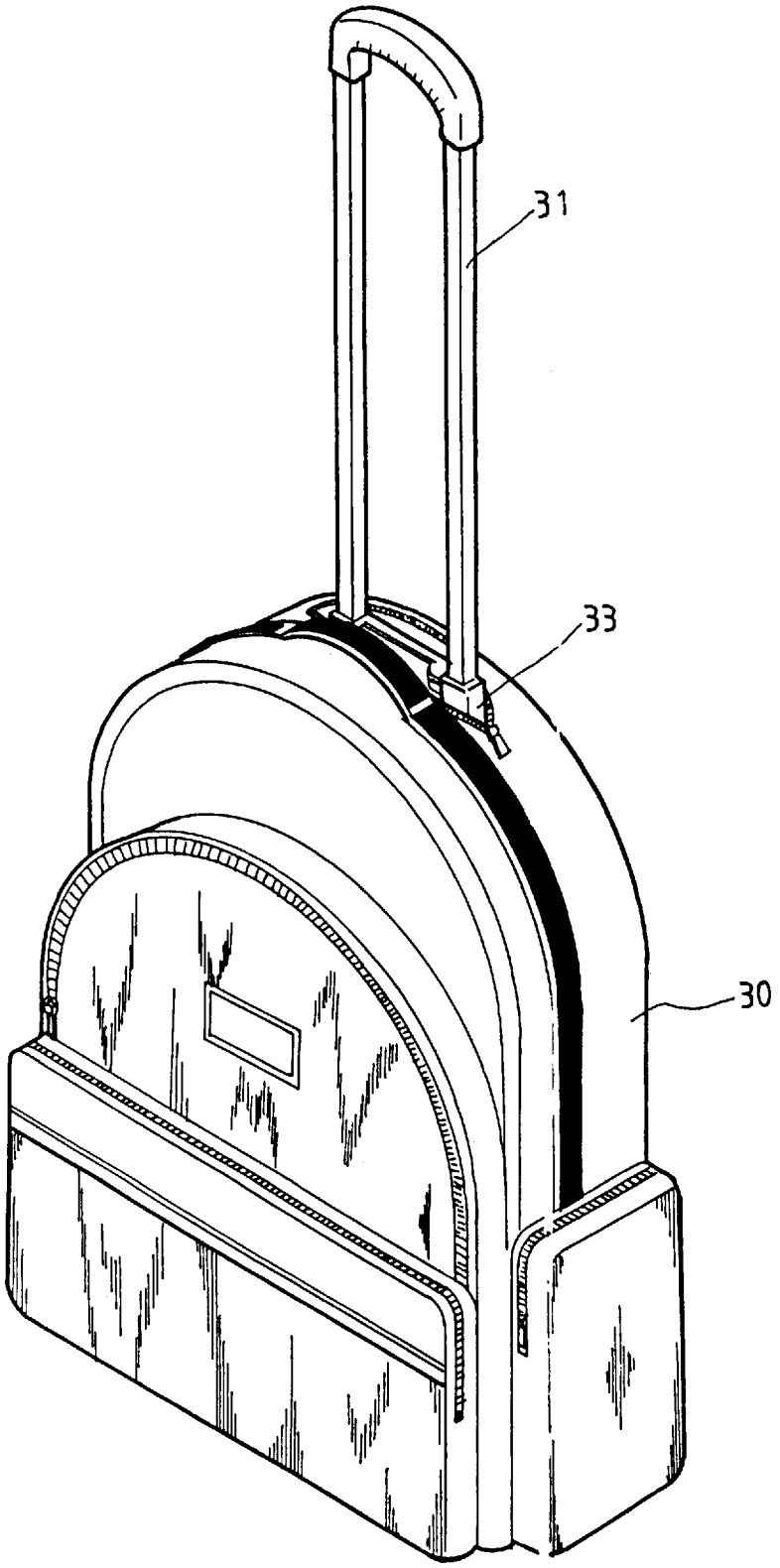
FIG. 6 is a perspective view illustrating the present invention at work.
Figure 7:
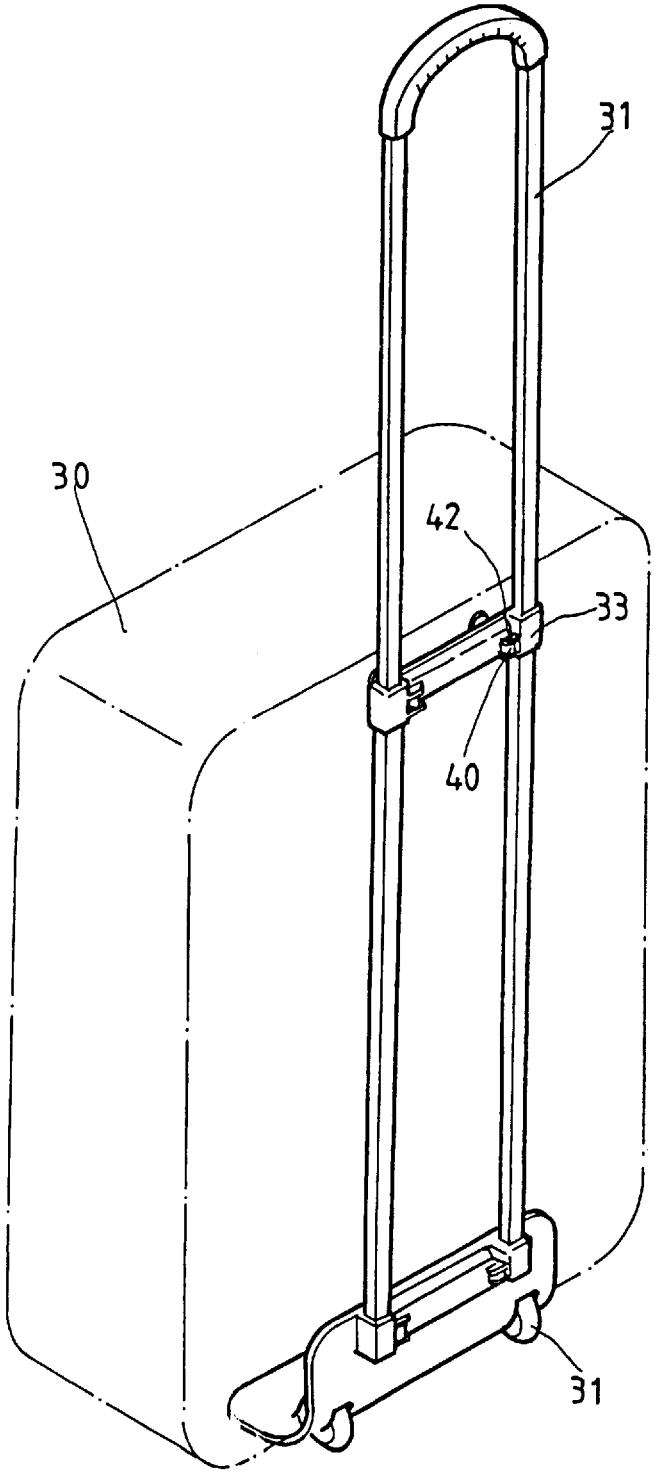
FIG. 7 is another perspective view illustrating the present invention at work.

As shown in FIGS. 3–7, a pull rod 31 of a U-shaped construction is movably fastened with a base 33 of the present invention, which is in turn fastened with a luggage shell 30. The luggage shell 30 is provided with two caster frames 32 fastened therewith.

The base 33 has a guide hole 34 through which the pull rod 31 is received. The base 33 further has a mounting hole 35 for fastening the base 33 with the luggage shell 30 in conjunction with a fastening member 36 which is engaged with a fastening hole 37 of the luggage shell 30.

The main feature of the present invention is the fastening member 36, which comprises a head 38, and two paralled arms 39 extending in the same direction from the head 38 such that the free ends of the parallel arms 39 form together a hooked portion 40. The mounting hole 35 of the base 33 is provided with a retaining slot 41 which is engaged with the hooked portion 40 of the fastening member 36. The mounting hole 35 is provided with two protective plates 42 opposite to each other for concealing the fastening member 36.

It must be noted here that the head 38 of the fastening member 36 of the present invention is pressed firmly against the luggage shell 30 such that the luggage shell 30 is not vulnerable to damage caused by the fastening member 36.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the hereinafter appended claims.

What is claimed is:

1. A base for mounting a luggage pull rod, said base comprising:

at least one guide hole for locating a luggage pull rod;

a mounting hole for fastening said base with a luggage shell, said mounting hole provided with a retaining slot and two protective plates opposite to each other such that said two protective plates are separated from each other by a space; and a fastening member for fastening said base with the luggage shell in conjunction with said mounting hole;

wherein said fastening member comprises a head and two arms extending in the same direction from said head such that free ends of said two arms form together a hooked portion engageable with said retaining slot of said mounting hole.

2. The base as defined in claim 1, wherein said two arms of said fastening member are parallel to each other.

3. The base as defined in claim 1, wherein said two arms of said fastening member are located in said space of said protective plates at such time when said fastening member is engaged with a fastening hole of the luggage shell.

* * * * *